US011957968B2

(12) United States Patent
Morabito et al.

(10) Patent No.: US 11,957,968 B2
(45) Date of Patent: Apr. 16, 2024

(54) BASEBALL AND SOFTBALL TRAINING AID

(71) Applicants: John Morabito, Vienna, VA (US); Jonathan Perlman, New York, NY (US); Dominic Morabito, Vienna, VA (US); Nicholas Edward Morabito, Vienna, VA (US)

(72) Inventors: John Morabito, Vienna, VA (US); Jonathan Perlman, New York, NY (US); Dominic Morabito, Vienna, VA (US); Nicholas Edward Morabito, Vienna, VA (US)

(73) Assignee: Perfect Swings USA LLC, Vienna, VA (US)

( * ) Notice: Subject to any disclaimer, the term of this patent is extended or adjusted under 35 U.S.C. 154(b) by 186 days.

(21) Appl. No.: 17/438,652

(22) PCT Filed: Mar. 9, 2020

(86) PCT No.: PCT/US2020/021732

§ 371 (c)(1),
(2) Date: Sep. 13, 2021

(87) PCT Pub. No.: WO2020/185694

PCT Pub. Date: Sep. 17, 2020

(65) Prior Publication Data

US 2022/0184479 A1 Jun. 16, 2022

Related U.S. Application Data

(60) Provisional application No. 62/817,809, filed on Mar. 13, 2019.

(51) Int. Cl.
*A63B 69/00* (2006.01)

(52) U.S. Cl.
CPC ..... *A63B 69/0075* (2013.01); *A63B 69/0002* (2013.01); *A63B 2069/0008* (2013.01);
(Continued)

(58) Field of Classification Search
CPC ..... A63B 69/0075; A63B 69/0002; A63B 2069/0008; A63B 2220/30;
(Continued)

(56) References Cited

U.S. PATENT DOCUMENTS 4,979,741 A * 12/1990 Butcher ..... A63B 69/0075 473/417
5,928,092 A 7/1999 Keeter
6,435,990 B1 * 8/2002 Bradley ..... A63B 69/0002 473/422
6,666,781 B1 12/2003 Illis
7,819,763 B2 * 10/2010 Campbell ..... A63B 69/0002 473/422

(Continued)

FOREIGN PATENT DOCUMENTS

KR 10200170077969 7/2017

OTHER PUBLICATIONS

International Search Report and Written Opinion for International Application No. PCT/US2020/021732, dated Apr. 24, 2020, 7 pages.

*Primary Examiner* — Mitra Aryanpour
(74) *Attorney, Agent, or Firm* — Wiley Rein LLP

(57) ABSTRACT

A batting training aid includes a base, a vertically-extending brace or leg supported by the base, and a plane attached to an upper end of the brace via a joint. The brace allows for adjustment of the height of the plane, while the joint between the plane and the brace allows the plane to roll, pitch, and/or yaw to mimic optimal swing planes for different pitch locations/angles and batter heights. The training aid can incorporate a batting tee for tee work and/or a resistive
(Continued)

medium to approximate contact during dry swings. A guide bar can be provided above the plane to prevent a hitter from swinging down on the ball. Sensors can be incorporated into the training aid to measure one or more swing metrics, such as bat speed; data collected by the sensors can be transmitted to external devices such as smartphones, tablets, personal computers, and the like.

14 Claims, 7 Drawing Sheets

(52) U.S. Cl.
CPC ..... *A63B 2220/30* (2013.01); *A63B 2220/802* (2013.01); *A63B 2220/89* (2013.01); *A63B 2225/093* (2013.01); *A63B 2225/50* (2013.01)

(58) Field of Classification Search
CPC ..... A63B 2220/802; A63B 2220/89; A63B 2225/093; A63B 2225/50
USPC ..... 473/451, 450, 458
See application file for complete search history.

(56) References Cited

U.S. PATENT DOCUMENTS

| | | | | |
|---|---|---|---|---|
| 7,967,704 | B2 * | 6/2011 | Schulte | A63B 69/0075 473/422 |
| 8,556,753 | B1 * | 10/2013 | Dixon, Jr. | A63B 69/0002 473/422 |
| 8,992,348 | B2 * | 3/2015 | Meier | A63B 69/0057 473/422 |
| 9,061,190 | B2 * | 6/2015 | Willardson | A63B 69/0075 473/453 |
| 10,874,924 | B2 * | 12/2020 | Walton | A63B 69/0002 473/453 |
| 2004/0266565 | A1 | 12/2004 | Andrews | |
| 2008/0248900 | A1 | 10/2008 | Hernandez | |
| 2014/0179465 | A1 | 6/2014 | Thomas et al. | |
| 2017/0065865 | A1 * | 3/2017 | Beedle | A63B 69/0075 473/451 |
| 2018/0290037 | A1 * | 10/2018 | Dilz, Jr. | A63B 24/0021 473/451 |
| 2022/0184479 | A1 * | 6/2022 | Morabito | A63B 69/0002 473/453 |

* cited by examiner

BASEBALL AND SOFTBALL TRAINING AID

CROSS-REFERENCE TO RELATED APPLICATIONS

This application claims the benefit of U.S. provisional application No. 62/817,809, filed 13 Mar. 2019, which is hereby incorporated by reference as though fully set forth herein.

BACKGROUND

The present disclosure relates generally to baseball and softball training aids. In particular, the present disclosure relates to an apparatus that helps baseball and softball players refine and improve their swings.

It is widely acknowledged that one of the hardest things to do in sports is hit a baseball. Accordingly, baseball players (and softball players as well) spend considerable time practicing their swings. Known techniques for practicing baseball and/or softball swings include live batting practice (that is, where a pitcher throws pitches for the batter to hit), tee work (that is, where the batter hits a ball off of a tee), and dry swings (that is, where the batter simply practices swinging without hitting a ball).

It is generally desirable for a swing to be a consistently reproducible motion, subject to slight adjustments to reach pitches at different positions within the strike zone (e.g., high, low, inside, outside, and over the middle of the plate). Yet, it is often the case that a hitter may use one motion for dry swings, another motion for tee work, and yet another motion for live batting practice. Thus, simply practicing swings may not lead to the desired improvement in game performance, and may, in some cases, entrain bad habits into muscle memory.

It is known, therefore, for hitters to employ various feedback mechanisms when practicing their swings. For instance, hitters may videotape themselves while swinging and then analyze their swing after the fact. This approach does not, however, offer corrective feedback in the moment. While a hitting coach can provide corrective feedback in the moment, it also increases expense for the hitter.

BRIEF SUMMARY

It would be desirable, therefore, to provide a batting training aid for baseball and/or softball players that provides corrective feedback in the moment, even when the hitter is practicing alone.

Disclosed herein is a batting training aid, including: a stand including a base and a brace supported by and extending upwardly from the base; and a batting plane attached to an upper end of the brace via a joint. A height of the batting plane can be adjusted via the brace, such as by incorporating a four-bar linkage or telescoping pole into the brace.

The joint between the batting plane and the brace desirably permits the batting plane to rotate about at least one axis, such as a roll axis (e.g., to raise/lower the inside/outside edges of the batting plane), a pitch axis (e.g., to raise/lower the front/back edges of the batting plane), and/or a yaw axis (e.g., to rotate the batting plane towards/away from the first and third baselines).

Embodiments of the batting training aid include a batting tee that extends above an upper surface of the batting plane. Alternatively or additionally, the batting training aid can include a resistive medium extending above an upper surface of the batting plane, which serves as both a target for a hitter and approximates the feeling of hitting a ball.

In embodiments, the batting training aid further includes a guide bar positioned above and parallel to an upper surface of the batting plane. The guide bar can be coupled to the batting training aid such that it can rotate about an axis extending vertically between the base and the batting plane.

It is also contemplated that the batting training aid can include a bat speed sensor, which, in embodiments of the disclosure, can be integrated into the batting plane. Suitable sensors include, but are not limited to, radar-based sensors, photoemitters, and acoustic (e.g., ultrasound) sensors. A transceiver can also be incorporated into the batting training aid in order to allow the bat speed sensor to communicate with one or more external devices, such as smartphones, tablets, personal computers, and the like.

Also disclosed herein is a batting training aid, including: a base; a batting plane; and a leg having an upper end connected to the batting plane and a lower end connected to the base, wherein a vertical distance between the upper end of the leg and the lower end of the leg is adjustable, and wherein the connection between the upper end of the leg and the batting plane permits the batting plane to rotate about at least a roll axis and, in embodiments of the disclosure, at least one axis in addition to the roll axis.

The batting training aid can also include a batting tee and/or at least one sensor to measure at least one batting metric (e.g., a bat speed sensor to measure bat speed as it passes through the hitting zone). In embodiments of the disclosure, the at least one sensor is integrated into the batting plane.

The foregoing and other aspects, features, details, utilities, and advantages of the present invention will be apparent from reading the following description and claims, and from reviewing the accompanying drawings.

While multiple embodiments are disclosed, still other embodiments of the present disclosure will become apparent to those skilled in the art from the following detailed description, which shows and describes illustrative embodiments. Accordingly, the drawings and detailed description are to be regarded as illustrative in nature and not restrictive.

DETAILED DESCRIPTION

Figure 1:
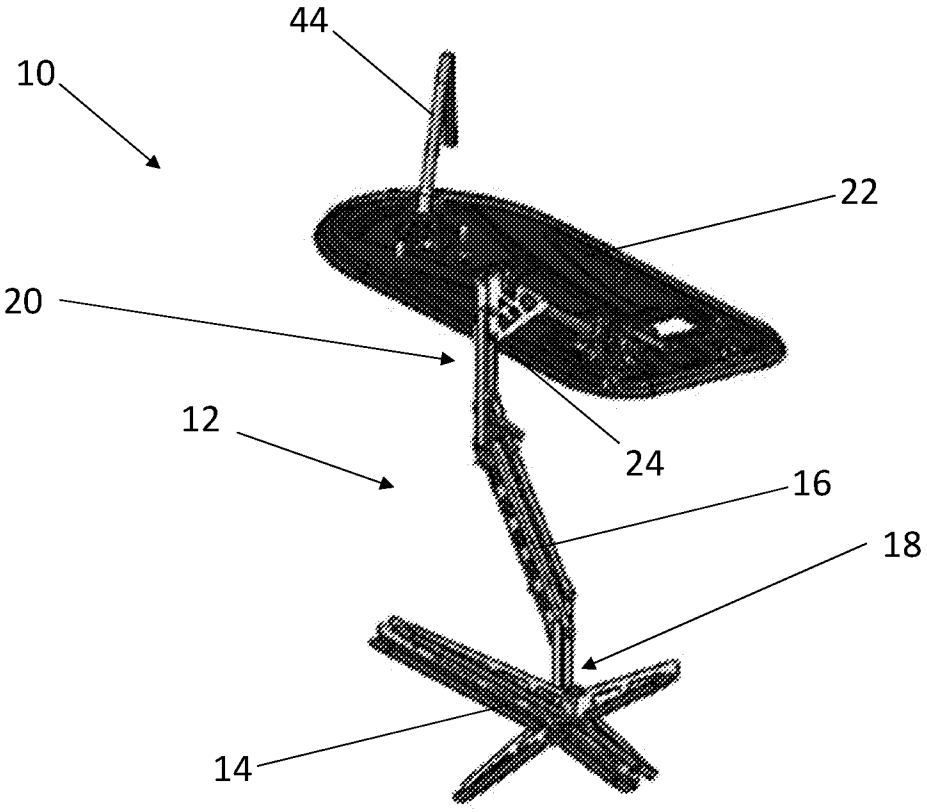
FIG. 1 is a perspective view of a batting training aid according to embodiments of the instant disclosure.

FIG. 1 depicts a batting training aid 10 according to aspects of the instant disclosure. As seen therein, batting training aid 10 generally includes a stand 12, which includes a base 14 and a brace or leg 16 that is supported by base 14 at its lower end 18. Brace or leg 16 extends upwardly from base 14 and is connected at its upper end 20 to a batting plane 22 via a joint 24.

Brace or leg 16 allows the height of batting plane 22 above base 14 to be adjusted, for example to accommodate different height hitters and/or to simulate pitches at different elevations within the strike zone. For instance, brace or leg 16 can incorporate a four-bar linkage, a telescoping pole, or a like mechanism that permits the height of batting plane 22 to be altered.

Figure 2:
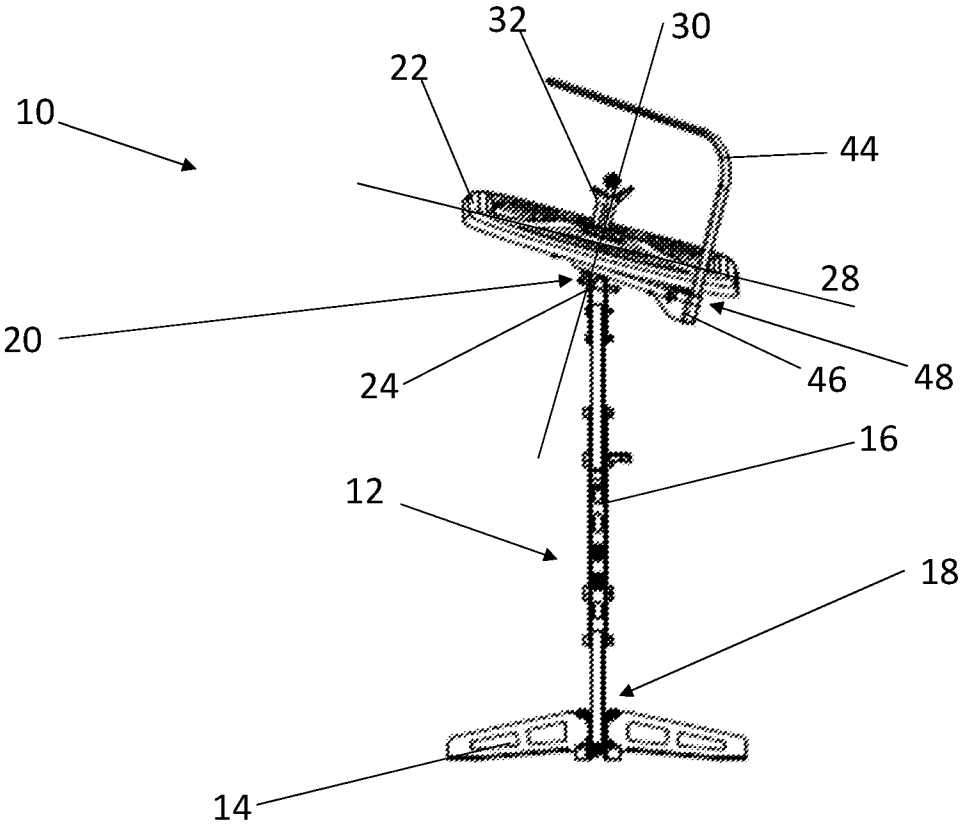
FIG. 2 is a front view of the batting training aid of FIG. 1.
Figure 3:
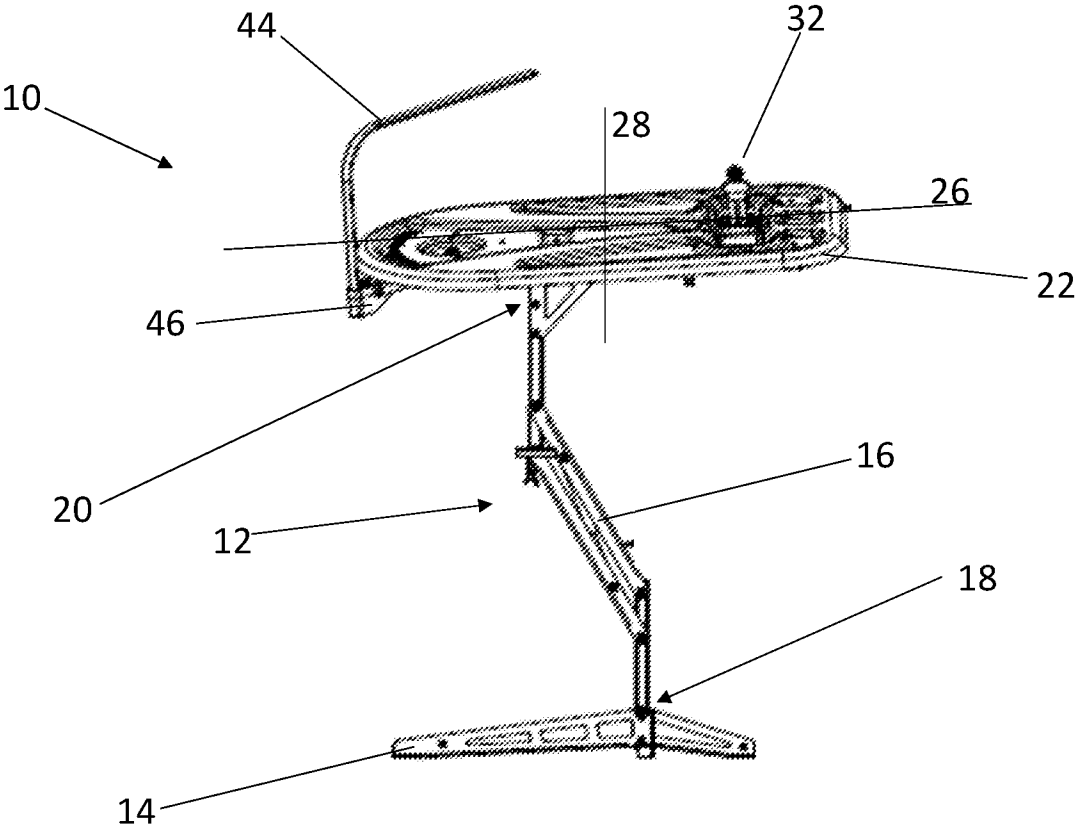
FIG. 3 is a side view of the batting training aid of FIG. 1.

Joint 24 permits batting plane 22 to rotate about at least one axis. In embodiments of the disclosure, therefore, joint 24 can incorporate one or more gimbals, allowing batting plane 22 to rotate about a roll axis 26 (which extends generally from the front of batting plane 22 to the rear of batting plane 22, as shown in FIG. 3), a pitch axis 28 (which extends generally from the outside edge of batting plane 22 to the inside edge of batting plane 22, as shown in FIGS. 2 and 3), and/or a yaw axis 30 (which extends perpendicular to the surface of batting plane 22, as shown in FIG. 2). Joint 24 thus permits batting plane 22 to be adjusted to simulate different incoming pitch angles, and correspondingly the optimal angle and path of the bat as it moves through the hitting zone.

Figure 4:
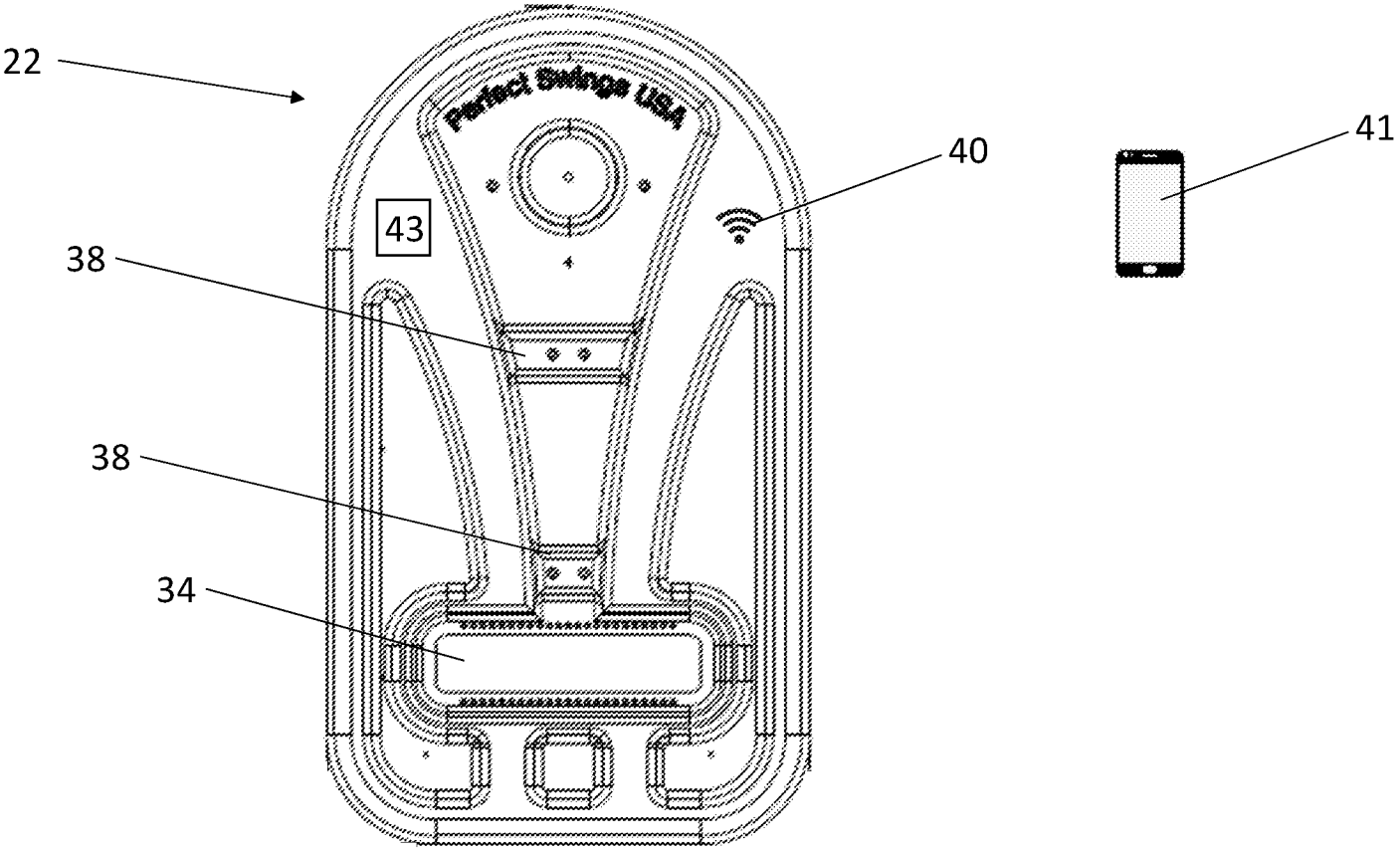
FIG. 4 is a top view of a batting plane according to aspects disclosed herein, and more particularly as depicted in the batting training aid of FIG. 1.

Embodiments of batting training aid 10 include a batting tee 32 that extends above the upper surface of batting plane 22 (e.g., from within an opening in batting plane 22, such as slot 34, shown in FIG. 4). It is contemplated that batting tee 32 may be able to slide within slot 34, so as to simulate pitches that are at the inside and outside extremes of the strike zone.

Figure 5:
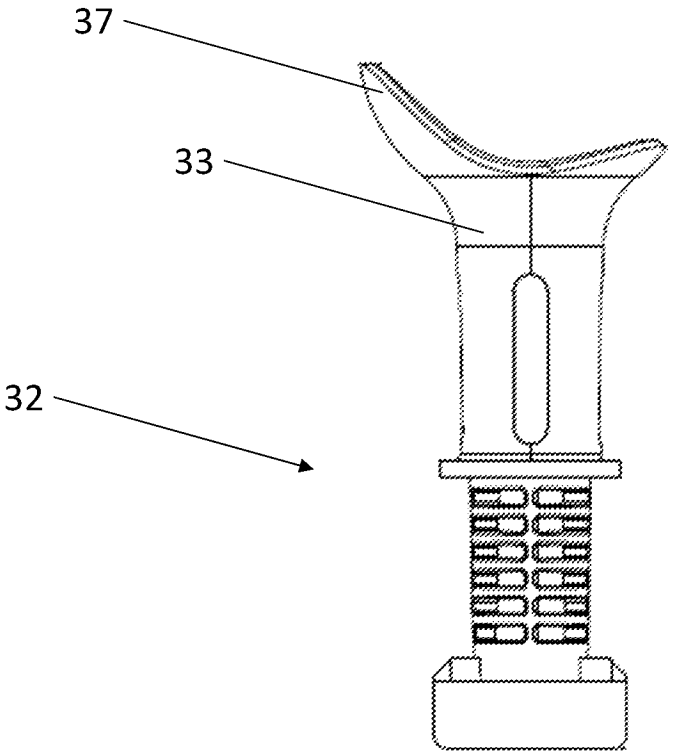
FIG. 5 depicts a batting tee topper according to embodiments of the instant disclosure

Those of ordinary skill in the art will be familiar with the basic construction of a batting tee 32, such that a detailed description thereof is not necessary herein. In general, however, and as shown in FIG. 5, batting tee 32 includes a cup-shaped topper 33 configured to hold a ball therein. According to aspects of the instant disclosure, topper 33 is not symmetrical. Rather, one side of topper 33 can include a higher wall 37, helping to ensure that a ball placed within topper 33 does not fall out even when batting plane 22 is set to high roll and/or pitch angles.

In alternative embodiments disclosed herein, the upper surface of batting plane 22 can include a cavity or divot to receive a ball.

Figure 6:
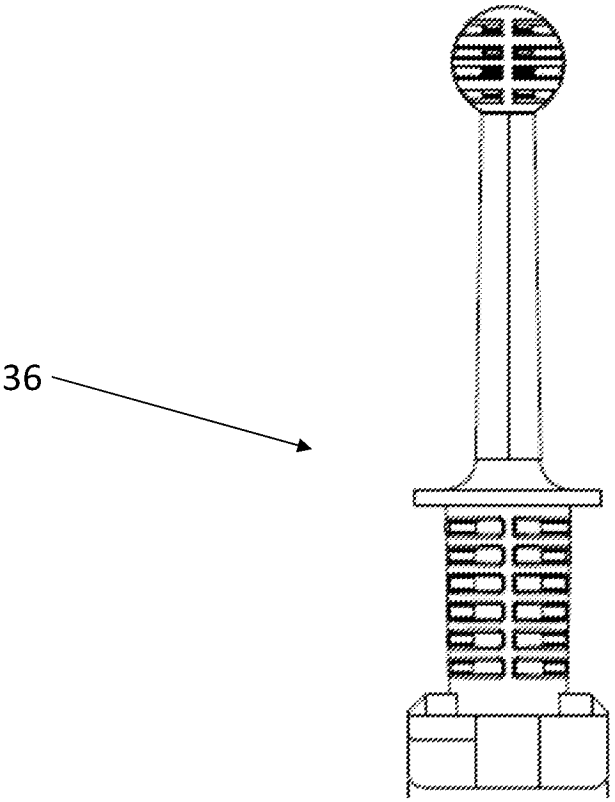
FIG. 6 depicts a dry swing target according to embodiments of the instant disclosure.

Because it may not be desirable to hit a ball in certain training environments, it is contemplated that hitters may also employ batting training aid 10 with dry swings. It is often desirable, however, to both provide a target and simulate the feel of hitting a ball during dry swing training. In this regard, FIG. 6 depicts a dry swing target 36, contact with which approximates the feel of hitting a ball, that can be secured within slot 34. In other embodiments, a resistive medium, such as a plurality of bristles extending above the upper surface of batting plane 22, can be used instead of dry swing target 36.

Batting training aid 10 can also incorporate a sensor to measure at least one swing metric, such as bat speed through the hitting zone. For instance, one or more sensors 38 can be attached to batting training aid 10 (e.g., integrated into batting plane 22) to measure bat speed as it passes through the hitting zone generally parallel to batting plane 22. Sensors 38 can be radar-based sensors, photoemitters, acoustic (e.g., ultrasonic) sensors, or any other suitable sensors.

Embodiments of batting training aid 10 can also include a transceiver 40 in operable communication with sensors 38. Thus, measurements made by sensors 38 can be transmitted (e.g., over Bluetooth, WiFi, or another suitable communications protocol) to an external device 41 (e.g., a smartphone, tablet, personal computer, or the like) for review/analysis (e.g., by a coach) and/or storage. Of course, it is also contemplated that batting training aid 10 can include, on board, a microprocessor (or microprocessors), memory, storage, or displays (shown in block form as electronics package 43), allowing certain data to be reviewed directly on batting training aid 10, whereas more sophisticated analysis may be available in an application running on external device 41, analogous to the functionality of extant fitness tracking devices.

In additional aspects, batting training aid 10 includes a guide bar 44. Guide bar 44 is positioned above the upper surface of batting plane 22 and extends generally parallel thereto. Guide bar 44 helps enforce a proper swing mechanic (e.g., on the same plane as an incoming pitch) by preventing a hitter from swinging down at the ball, because a downward swing would collide with guide bar 44. Guide bar 44 can be attached to an arm 46, which is in turn attached to batting training aid 10 such that it can rotate about yaw axis 30 (e.g., the vertical axis generally defined by brace or leg 16). For instance, guide bar 44 can be attached to brace or leg 16, or attached directly to the lower surface of batting plane 22. In substantially any case, a hitter can rotate guide bar 44 to the outside of the strike zone (that is, to the edge of batting plane 22 furthest away from the hitter) regardless of whether the hitter is right- or left-handed; clips 48 can be provided on batting plane 22 to secure guide bar 44 in position. The height of guide bar 44 over batting plane 22 can also be adjusted so as to allow hitters more (higher) or less (lower) room for entry of their bats into the hitting zone.

Although several embodiments have been described above with a certain degree of particularity, those skilled in the art could make numerous alterations to the disclosed embodiments without departing from the spirit or scope of this invention.

For example, in embodiments of the disclosure, a reversible tee can include cup-shaped topper 33 on one side and dry swing target 36 on the opposite side, allowing a user to quickly and conveniently adapt batting training aid 10 for live or dry swings simply by removing, reversing, and reinserting the reversible tee into slot 34.

Figure 7:
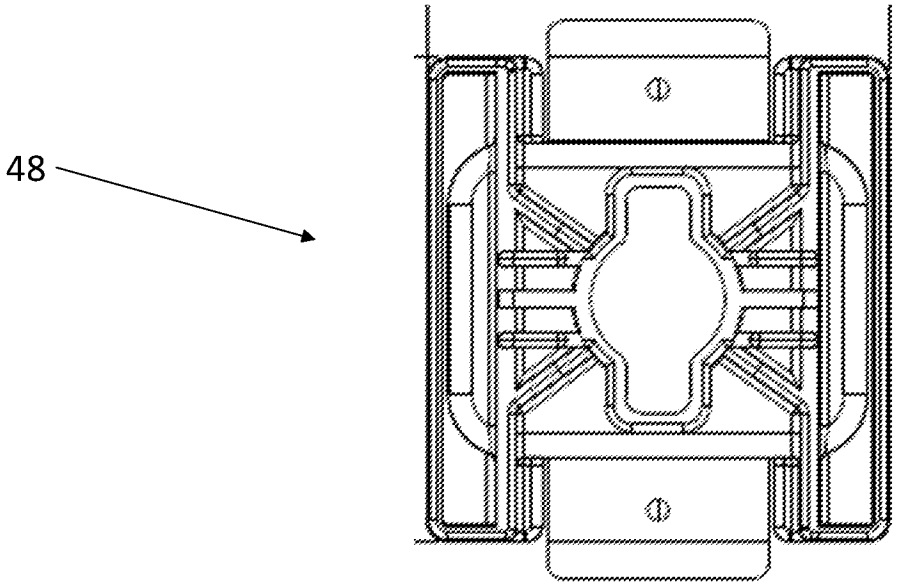
FIG. 7 depicts a retainer for the batting tee topper of FIG. 5 and/or the dry swing target of FIG. 6.

Of course, it is also contemplated that batting tee 32 and dry swing target 36 can be separate pieces that may be interchangeably secured within slot 34. In this regard, FIG. 7 shows a tee topper retainer 48 that may be secured within slot 34. Depending on the hitter's desired training, either batting tee 32 or dry swing target 36 can be secured to tee topper retainer 48, such as via a snap-fit, twist-to-lock, or other suitable connection between the two pieces. The unused component can be secured in a storage position underneath batting plane 22 for easy retrieval.

All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A batting training aid, comprising:

a stand including a base and a brace supported by and extending upwardly from the base;

a planar batting surface attached to an upper end of the brace via a joint; and a guide bar positioned above and parallel to the planar batting surface, wherein the guide bar is coupled to the batting training aid such that the guide bar can rotate about an axis extending vertically between the base and the planar batting surface.

2. The batting training aid according to claim 1, wherein a height of the planar batting surface above the base is adjustable via the brace.

3. The batting training aid according to claim 2, wherein the brace comprises a four-bar linkage.

4. The batting training aid according to claim 1, wherein the joint permits the planar batting surface to rotate about at least one axis.

5. The batting training aid according to claim 4, wherein the joint permits the planar batting surface to rotate about a roll axis.

6. The batting training aid according to claim 4, wherein the joint permits the planar batting surface to rotate about a pitch axis.

7. The batting training aid according to claim 1, further comprising a batting tee extending above an upper surface of the planar batting surface.

8. The batting training aid according to claim 1, further comprising a resistive medium extending above an upper surface of the planar batting surface.

9. The batting training aid according to claim 1, further comprising a bat speed sensor.

10. The batting training aid according to claim 9, wherein the bat speed sensor is integrated into the planar batting surface.

11. The batting training aid according to claim 9, wherein the bat speed sensor comprises a radar-based sensor.

12. The batting training aid according to claim 9, wherein the bat speed sensor comprises at least two photoemitters.

13. The batting training aid according to claim 9, wherein the bat speed sensor comprises at least two ultrasonic sensors.

14. The batting training aid according to claim 9, further comprising a transceiver to establish communication between the bat speed sensor and one or more devices external to the batting training aid.

* * * * *